US010597265B2

(12) United States Patent
Patel et al.

(10) Patent No.: US 10,597,265 B2
(45) Date of Patent: Mar. 24, 2020

(54) SLIDER FOR USE WITH A CRANE

(71) Applicant: HIGH CONCRETE GROUP LLC, Lancaster, PA (US)

(72) Inventors: Vivek Patel, Lancaster, PA (US); Jay Hauseman, Lancaster, PA (US); Daniel Andrus, Lancaster, PA (US); David Wasik, Lancaster, PA (US); Douglas Lance Lorah, Cochranville, PA (US); Lucas Harkcom, Lancaster, PA (US)

(73) Assignee: High Concrete Group, LLC, Lancaster, PA (US)

( * ) Notice: Subject to any disclaimer, the term of this patent is extended or adjusted under 35 U.S.C. 154(b) by 519 days.

(21) Appl. No.: 15/343,572

(22) Filed: Nov. 4, 2016

(65) Prior Publication Data

US 2017/0129748 A1 May 11, 2017

Related U.S. Application Data

(60) Provisional application No. 62/252,084, filed on Nov. 6, 2015.

(51) Int. Cl.

| | |
|---|---|
| ***B66C 19/00*** | (2006.01) |
| ***B66C 11/24*** | (2006.01) |
| ***B66C 11/06*** | (2006.01) |

(52) U.S. Cl.

CPC ..... *B66C 19/005* (2013.01); *B66C 11/06* (2013.01); *B66C 11/24* (2013.01)

(58) Field of Classification Search

CPC ..... B66C 11/00; B66C 11/04; B66C 11/06; B66C 11/16; B66C 11/18; B66C 9/00; B66C 9/02; B66C 9/14; B66C 19/00; B66C 19/002; B66C 19/005; B66C 19/007; B66C 19/02; B66C 11/24

USPC ..... 212/321

See application file for complete search history.

(56) References Cited

U.S. PATENT DOCUMENTS

| | | | | |
|---|---|---|---|---|
| 4,284,159 | A * | 8/1981 | Voelz | B66C 19/007 180/414 |
| 4,433,952 | A | 2/1984 | Glickman | |
| 4,444,287 | A * | 4/1984 | Voelz | B66C 19/007 180/252 |
| 4,844,682 | A | 7/1989 | Edelhoff | |
| 4,904,142 | A | 2/1990 | Sato | |
| 5,461,985 | A * | 10/1995 | Gersemsky | B66C 9/14 104/95 |
| 5,893,471 | A * | 4/1999 | Zakula | B66C 13/08 212/316 |

(Continued)

*Primary Examiner* — Michael R Mansen
*Assistant Examiner* — Juan J Campos, Jr.
(74) *Attorney, Agent, or Firm* — Saxton & Stump, LLC

(57) ABSTRACT

An embodiment is directed to a slider and method for moving a hoist on a crane. The slider includes a hoist support member and mounting arms. The mounting arms extend from either end of the support member. A portion of each mounting arm is spaced from the support member to form a flange receiving slot which is dimensioned to receive a flange a beam of the crane. The slider is provided with a resilient member to resiliently maintain the slider in a position in which the slider is movable relative to a beam of the crane when no load is applied to the slider. The resilient member is compressed when a load is applied to the slider to allow the slider to frictionally engage the beam to prevent the slider from continued movement relative to the beam.

17 Claims, 7 Drawing Sheets

(56) References Cited

U.S. PATENT DOCUMENTS

| | | | | |
|---|---|---|---|---|
| 6,522,468 | B2 | 2/2003 | Hayashi | |
| 7,546,929 | B2 | 6/2009 | Wierzba et al. | |
| 7,926,671 | B2 | 4/2011 | Wierzba et al. | |
| 9,302,891 | B2 | 4/2016 | Wierzba et al. | |
| 2005/0092201 | A1* | 5/2005 | Winter | B66C 9/14 104/96 |
| 2006/0102578 | A1* | 5/2006 | Zakula, Sr. | B66C 13/22 212/283 |
| 2006/0180564 | A1* | 8/2006 | Keppel | B66C 9/08 212/330 |
| 2007/0095776 | A1* | 5/2007 | Wierzba | B66C 13/18 212/344 |
| 2007/0095777 | A1* | 5/2007 | Wierzba | B66C 11/04 212/345 |

* cited by examiner

SLIDER FOR USE WITH A CRANE

FIELD OF THE INVENTION

The invention is directed to a slider for use on a crane, travel lift or similar device. The invention is also directed to device, system and method to remotely adjust the location of sliders on a crane, travel lift or similar device.

BACKGROUND OF THE INVENTION

Known sliders for use with a crane require manual adjustment to move the sliders to the proper position with respect to the load to be lifted. This requires that the sliders be brought to a level in which operators can physically move the sliders to the proper position. As the sliders are generally heavy, the movement of the sliders relative to the beam on which they slide is difficult, which can result in injuries to the operators. In addition, the process of manually adjusting the sliders is time consuming.

It would, therefore, be beneficial to provide a reliable remotely operated system slider system which can be operated manually if required.

SUMMARY OF THE INVENTION

An object is to provide slider, system and method in which the slider can be operated remotely, but which can also be operated manually if required.

An object is to provide a remote slider, system and method which is safe for operators to use, time efficient to adjust, and cost effective, without comprising the crane's maximum load capability.

An object is to provide a remote system which allows sliders to be moved to a specific destination on the crane, within approximately a 1 inch tolerance.

An object is to provide a slider which has compression springs provided proximate wheels of the slider. As a load is applied on the slider, the springs will compress, causing the slider's bottom face to come into contact with a flange of an I-beam, causing the bottom face to act as a friction brake, and stop the sliders from moving while the load is attached. When no external load is applied, the springs will remain uncompressed, and therefore, the bottom face of the slider will not be in contact with the flange of the I-beam.

An object is to provide a slider which has pulley system is provided to drive the slider. Pulleys are attached to a motor which can rotate both counterclockwise and clockwise, depending on the desired translation of the sliders.

An object is to provide a slider which has four wheels, two on each side of the beam, the wheels provide reduce friction so that the sliders translate along the beam with less applied force.

An embodiment is directed to a slider for moving a hoist on a crane. The slider includes a hoist support member and mounting arms. The mounting arms extend from either end of the support member. A portion of each mounting arm is spaced from the support member to form a flange receiving slot which is dimensioned to receive a flange of a beam of the crane. The flange receiving slot is dimensioned to allow the slider to move in a direction parallel to the longitudinal axis of the beam while preventing movement of the slider in a direction perpendicular to the beam.

An embodiment is directed to a crane for lifting heavy loads. The crane includes a beam having a flange, a hoist for lifting the loads and a drive mechanism for moving the slider relative to the beam. A slider is provided for moving the hoist. The slider includes a hoist support member and mounting arms extending from either end of the support member. A portion of each mounting arm is spaced from the support member to form a flange receiving slot which is dimensioned to receive the flange of the beam.

An embodiment is directed to a method of moving a slider mechanism on a crane. The method includes: providing a resilient member to resiliently maintain the slider in a position in which the slider is movable relative to a beam of the crane when no load is applied to the slider; and compressing the resilient member when a load is applied to the slider to allow the slider to frictionally engage the beam to prevent the slider from continued movement relative to the beam.

DETAILED DESCRIPTION OF THE INVENTION

Figure 1:
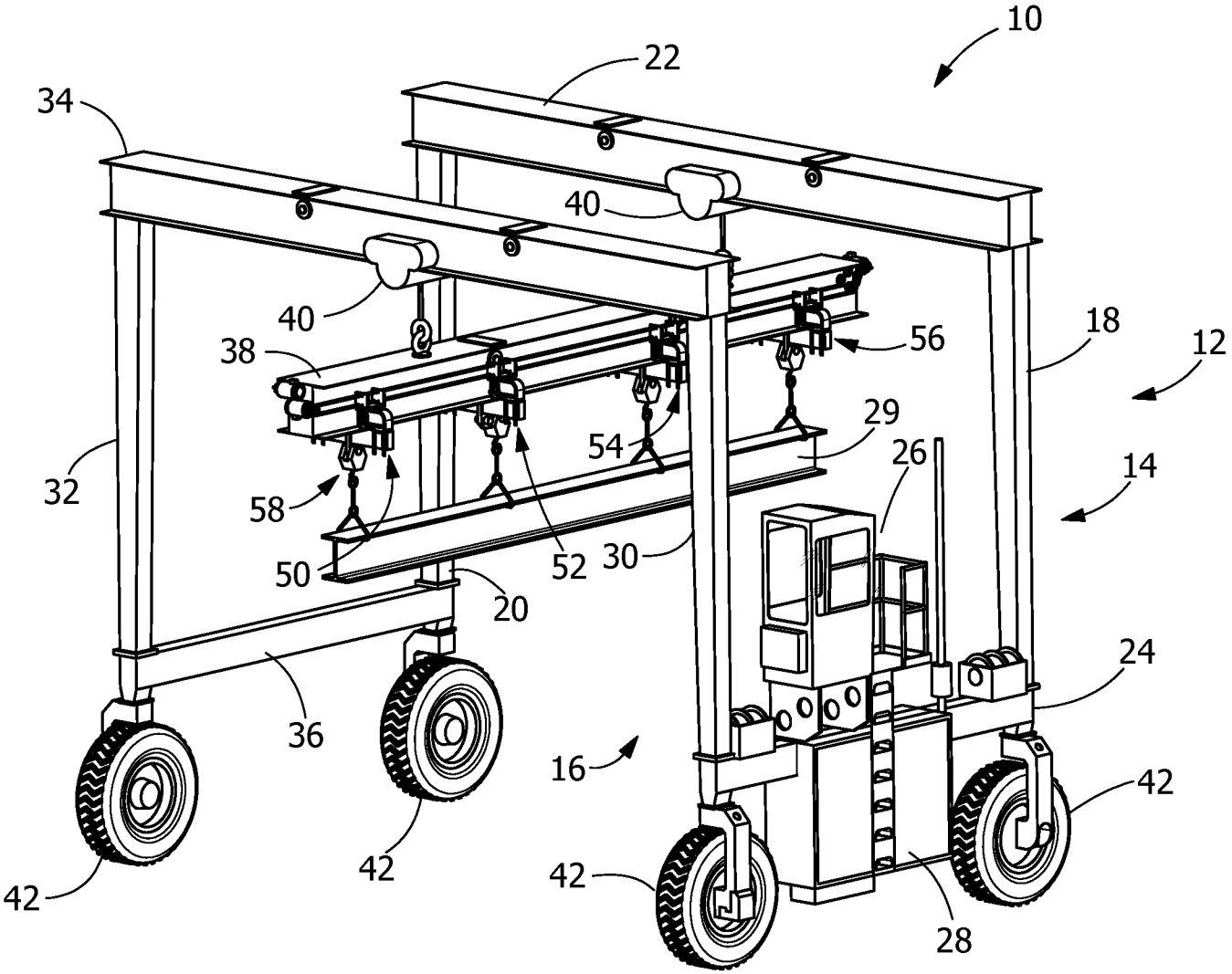
FIG. 1 is a perspective view of an illustrative crane using the movable sliders according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

FIG. 1 shows an illustrative load lifting assembly in the form of a gantry crane 10 with load lifting features. It is understood that the gantry crane 10 can take various forms.

The gantry crane 10 has a support structure or frame 12. The frame 12 generally has a right support 14 and a left support 16 (reference to the "right" and "left" sides is from the perspective of one viewing the gantry crane 10 as it appears in FIG. 1). The right support 14 and the left support 16 are substantially identical in significant respects.

Referring to FIG. 1, the right support 14 includes a right first vertical leg 18, a right second vertical leg 20, and a right cross beam 22. The right cross beam 22 24 spans between and connects the right first vertical leg 18 and the right second vertical leg 20

Also referring to FIG. 1, the left support 16 similarly includes a left first vertical leg 30, a left second vertical leg 32, and a left cross beam 34. The upper beam 34 spans between and connects the left first vertical leg 30 and the left second vertical leg 32.

A lower beam 24 spans between and connects the right first vertical leg 18 and the left first vertical leg 30. A lower beam 36 spans between and connects the right second vertical leg 20 and the left second vertical leg 32. In the illustrative embodiment shown, the lower beam 24 supports an operator cab 26 and control cabinets 28 that house various motors and controls utilized to operate the gantry crane 10.

A load bearing beam 38 extend below the cross beams 22, 34. The length of the load bearing beam 38 may be less than, equal to, or greater than the length of the lower beams 24, 36. The load bearing beam 38 are connected to the cross beams 22, 34 by means of hoists 40, or other known devices.

Wheels 42 are located near a lower end of the right first vertical leg 18, the right second vertical leg 20, the left first vertical leg 30, and the left second vertical leg 32.

The wheel base of the gantry crane 10 is the distance between the center of the rear wheels and the center of the front wheels. The width of the gantry crane 10 is the distance between the mid-plane of the right wheels and the mid-plane of the left wheels. The four wheels 42 allow for a mobile gantry frame 12. To accommodate such mobility, the gantry crane 10 can include a steering system used to control movements of the gantry structure.

The operator cab 26 shown attached to the right support 14 can take other forms and be positioned at different locations. The operator cab 26 could also be mounted for vertical and/or horizontal movement between various locations. The control cabinets 28 could also be mounted in various locations.

The gantry crane 10 includes features for lifting and moving loads 29. Specifically, in the illustrative embodiment shown, the load bearing beam 38 includes a first hoist mechanism 50, a second hoist mechanism 52, a third hoist mechanism 54 and a fourth hoist mechanism 56. Each of the hoist mechanisms 50, 52, 54, 56 includes a trolley or slider assembly 60, 62, 64, 66, or other similar structure, to facilitate lateral movement along the load bearing beam 38.

The first slider assembly 60 is connected to a chain or cable 70 which is operated by drive mechanisms or pulleys 80*a* and a motor 90 located on the left side of the load bearing beam 38. Drive mechanisms or pulleys 80*b*, located on the right side of the load bearing beam 38, cooperate with the cable 70 to create a symmetric motion loop for the first slider assembly 60. In the embodiment shown, the slider 60 is directly linked to the pulleys 80*a*, 80*b* by a steel wire 70.

The second slider assembly 62 is connected to a chain or cable 72 which is operated by drive mechanisms or pulleys 82*a* and a motor 92 located on the right side of the load bearing beam 38. Drive mechanisms or pulleys 82*b*, located on the left side of the load bearing beam 38, cooperate with the cable 72 to create a symmetric motion loop for the second slider assembly 62. In the embodiment shown, the slider 62 is directly linked to the pulleys 82*a*, 82*b* by a steel wire 72.

The use of respective motors 90, 92 allows the sliders 60, 62 to be independently controlled, allowing the sliders 60, 62 to be moved closer to or further from each other as required.

The third slider assembly 64 may be connected to cable 70, cable 72 or other cables which are operated by pulleys and a motor as described above.

The fourth slider assembly 66 may be connected to cable 70, cable 72 or other cables which are operated by pulleys and a motor as described above.

The use of respective motors allows the sliders 64, 66 to be independently controlled, allowing the sliders 64, 66 to be moved closer to or further from each other as required.

Figure 2:
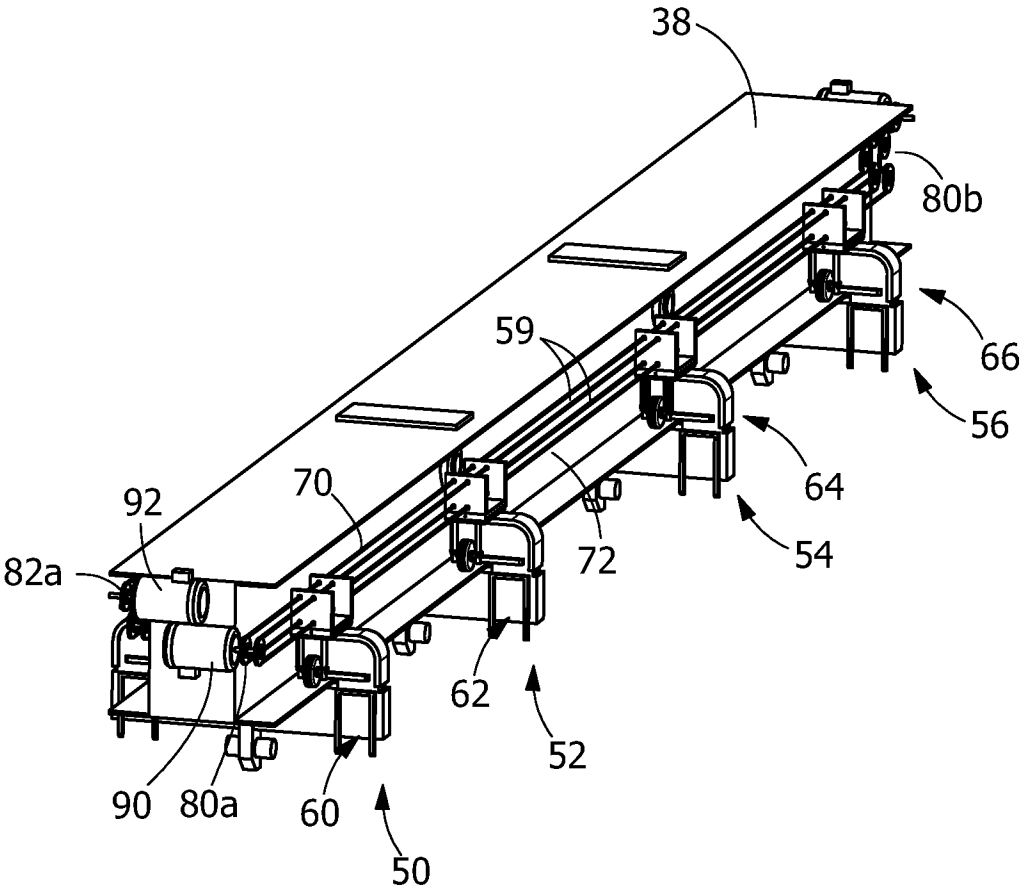
FIG. 2 is a perspective view of a beam from the crane of FIG. 1, illustrating the sliders of the present invention.

In the illustrative embodiment shown, the motors 90, 92 are bolted onto ends of the load bearing beam 38, as best shown in FIG. 2. The motors 90, 92 drive respective pulleys 80*b*, 82*b* which are attached directly to the motors 90, 92 as described above. The motors 90, 92 rotate both counter-clockwise and clockwise, depending on the desired translation of the sliders 60, 62, 64, 66.

Each hoist 50, 52, 54, 56 includes a load engagement member or element 58 for connecting the hoist mechanism either directly or indirectly to a load. In the illustrative embodiment of FIG. 1, each hoist mechanism includes a load engagement member 58 in the form of a hook. Cables 59 in the hoist mechanisms 50, 52, 54, 56 are used to extend and retract the hooks, and to thus, lift and lower a load. A hydraulic system (not shown), or other known system, is used to control and operate the hoist mechanisms 50, 52, 54, 56.

The lift assembly is designed to lift and manipulate heavy loads that may weigh many tons apiece. For example, in a typical application, each cross-beam 22, 34 of a gantry crane 10 is rated for capacity of 25 tons, for a total of 50 tons (the capacity rating is the maximum weight the component can safely lift without undue risk of failure or structural damage). Therefore, when only two hoist mechanisms and sliders are used on each the load bearing beam, each hoist mechanism and slider must be rated for a capacity of 25 tons. Alternatively, if more than two hoist mechanisms and sliders are used on the load bearing beam, the total rating for all of the hoist mechanisms and sliders on the load bearing beam must be rated for a capacity of 50 tons or less.

Referring to FIGS. 2-5, the sliders 60, 62, 64, 66 will be described. As each slider 60, 62, 64, 66 is essentially identical, for ease of explanation and understanding, only slider 60 will be described in detail. However, the same description is applicable to sliders 62, 64, 66.

Figure 3:
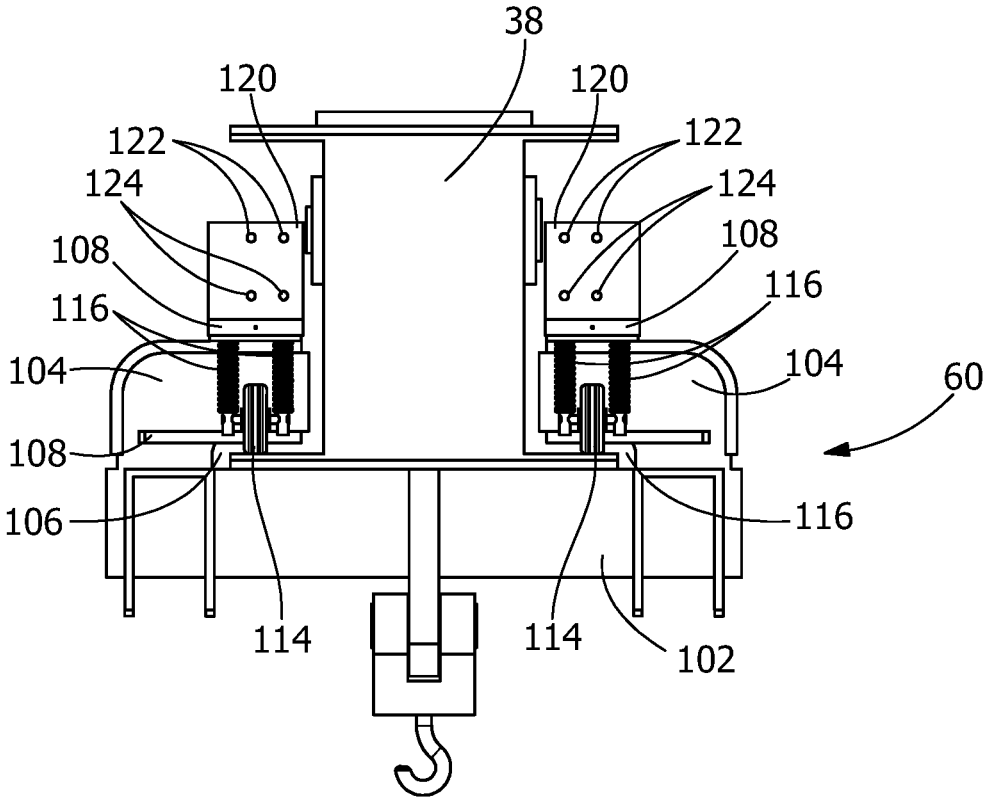
FIG. 3 is a front view of a slider of FIG. 2, the slider is shown with the springs in an uncompressed state to allow for movement of the slider relative to the beam.
Figure 4:
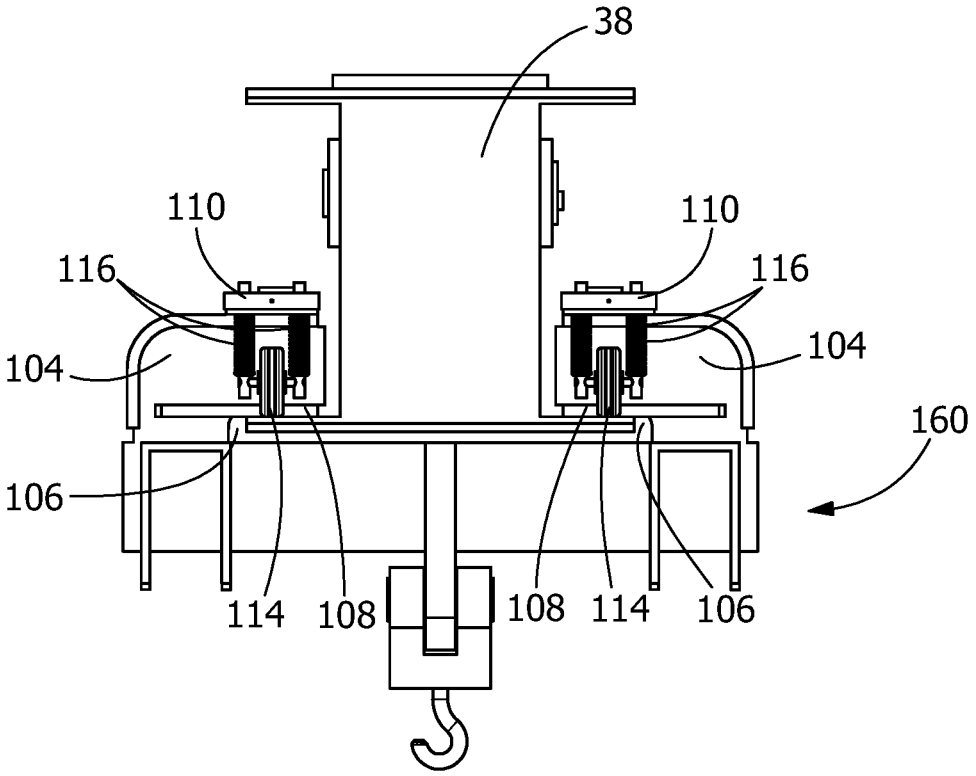
FIG. 4 is a front view of a slider of FIG. 3, the slider is shown with the springs in a compressed state to prevent the movement of the slider relative to the beam.
Figure 5:
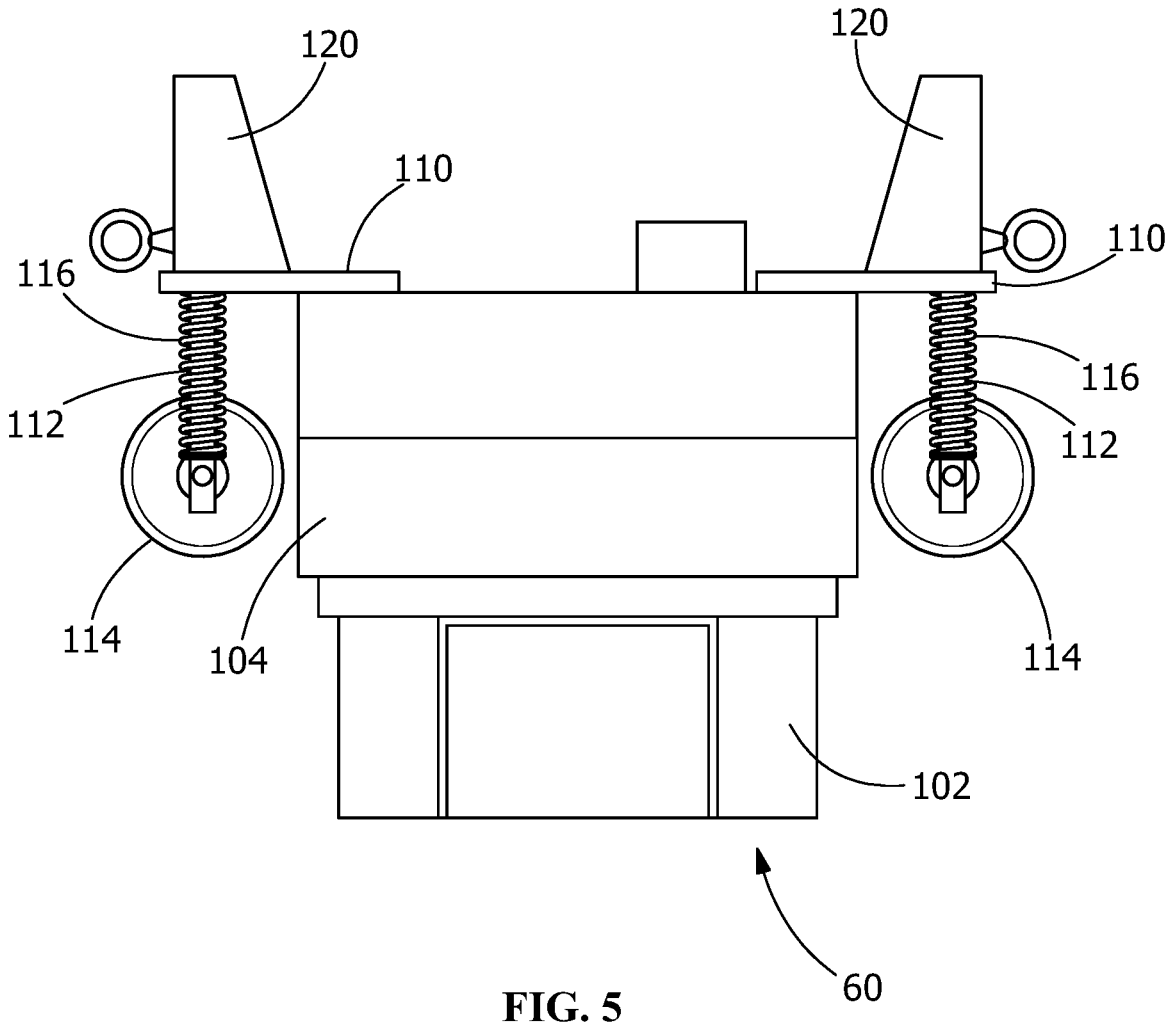
FIG. 5 is a side view of a slider of FIG. 2.
Figure 6:
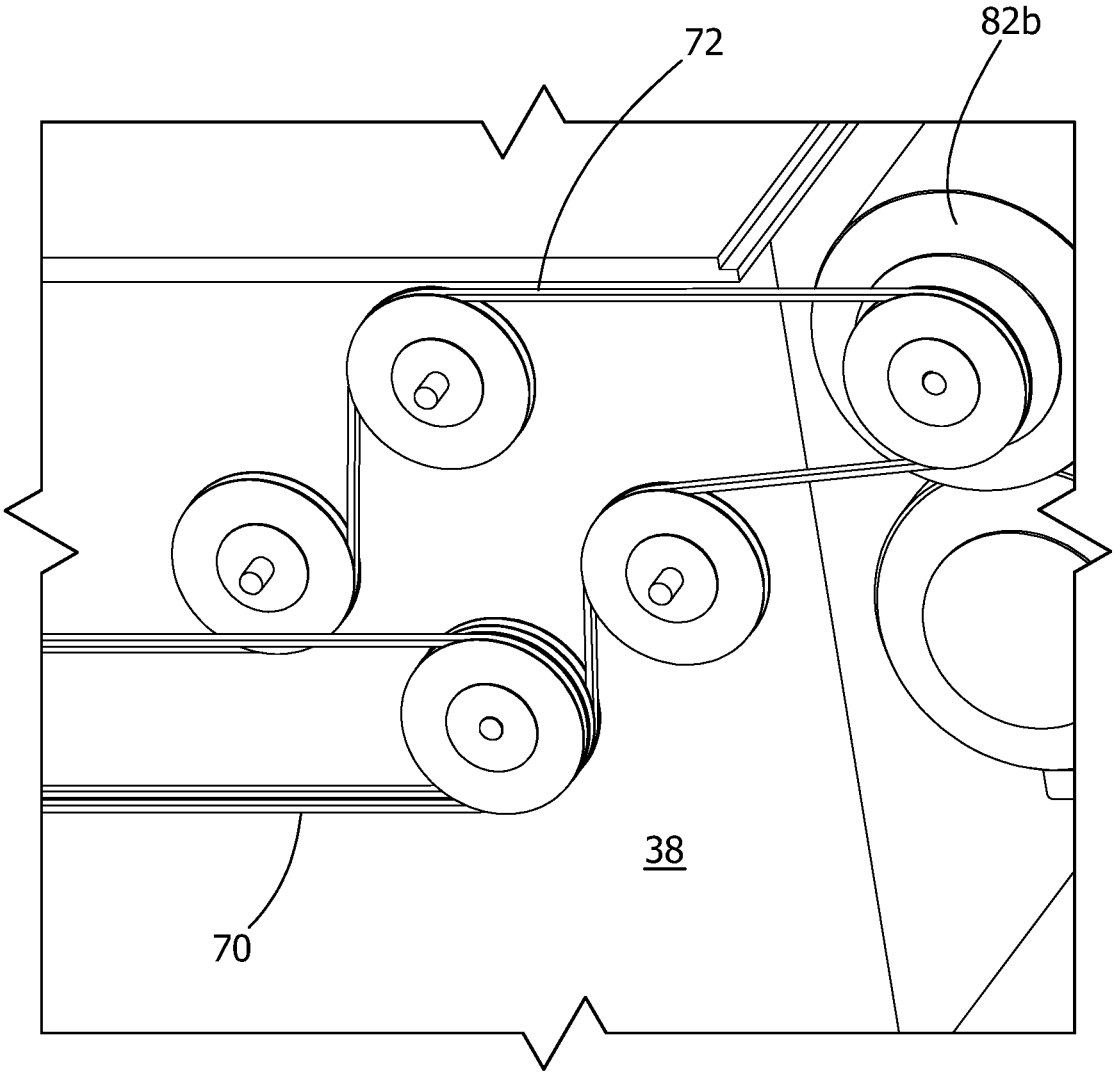
FIG. 6 is a view of an illustrative array of pulleys used to move the slider.

Slider includes a hoist support member 102 which extends under respective load bearing beam 38. The length of the support member 102 is greater than the width of the load bearing beam 38. The load engagement element 58 extends from the support member 102. Mounting members or arms 104 extend from either end of the support member 102. A portion of each mounting arm 104 is spaced from the support member 102 to form a flange receiving slot 106. As best shown in FIGS. 2-4, the slot 106 is dimensioned to receive a flange of the load bearing beam 38 therein. The slot 106 is dimensioned to allow the slider 60 to move in a direction parallel to the longitudinal axis of the load bearing beam 38 when no load is applied to the slider 60. However, movement of the slider 60 in a direction perpendicular to the load bearing beam 38 is prevented by the positioning of the support member 102 and the mounting arms 104. A beam engagement plate 108 extends from portions of the mounting arms 104 into the slots 106.

Wheel mounting members 110 are attached to and extend from the mounting arms 104. Each mounting arm 104 has two wheel mounting members 110, with each wheel mounting member 110 extending from opposite sides of the mounting arm 104.

Rods or axles 112 extend from the wheel mounting members 110 and engage wheels 114. Each wheel 114 has two axles 112 connected thereto. The axles 112 are movably attached to the wheel mounting members 110 to allow the rods 112 to move relative to the wheel mounting members 110. Compression springs or shocks 116 are provided on each axle 112 to control the movement of the axles 112 and wheels 114.

Different wheels 114 may be used, which include, but are not limited to, a rubber wheel, a high capacity steel wheel and a flange wheel. In the illustrative embodiment shown, the wheels 114 are 4" diameter rubber wheels are used which have inner bearings that provide an easy start that will minimize tension in the wire and will require a minimum amount of horsepower to move. The wheels have a capacity of 450 pounds which support the weight of the slider when the slider is not engaged with a load. The rubber will provide a strong coefficient of friction that will allow for the motion of the wheel to be in full rotation. The rubber wheel is also lightweight, cost-effective, safe and reliable. The rubber wheels provide traction so that the sliders 60, 62, 64, 66 move along the load bearing beam 38 without slipping. The wheels 114 effectively reduce the amount of force needed to push or pull the sliders 60, 62, 64, 66.

The compression springs or shocks 116 support the weight of the slider without creating contact on the load bearing beam flange when no load is applied to the slider. In the illustrative embodiment shown, the springs or shocks 116 are a tempered steel die spring with a length of 4.5", maximum load capacity of 223 pounds and a spring constant of 330 pounds per inch. The maximum load capacity is well below the maximum load capacity of the wheels of 400 pounds, which was necessary, so that the wheel does not carry more weight than it can support.

Cable or wire attachment members 120 extend from the wheel mounting members 110 or the mounting arms 104. The cable attachment members 120 have openings 122 which are dimensioned to receive and engage the cable 70 to allow the cable attachment members 120 and respective slider 60 to move as the cable 70 is moved. Alternatively, openings 124 may be provided which are dimensioned to be larger than cables 70, thereby allowing cables 70 to be moved without moving the slider.

In the illustrative embodiment shown, the cable 70 is a corrosion resistant wire with a ¼" diameter which has a load capacity greater than the frictional force that is preventing the slider from moving while uncompressed. The corrosion resistance allows for use in different operating environments, including in outdoor environments. Therefore, the design is subject to dirt, dust and a variety of weather conditions. The 0.25" cable 70 is rated for a lifting limit of 1080 pounds. With the maximum weight of the slider at 600 pounds, this cable 70 provides a factor of safety which is slightly less than 2.

In operation, the pulley drive sliders 60, 62, 64, 66 are controlled by means of the control cabinet 28. For example, the control cabinet 28 may a control panel with 2 rocker switches, an emergency stop button, and a power on/off button, with the rocker switches controlling the sliders 60, 62, 64, 66 movement towards the center of the load bearing beam 38 or away from the center. Based on operator input, the control cabinet 28 starts the respective needed motors 90, 92 which will drive the respective pulleys 80, 82. When no load is applied to the hoist mechanisms 50, 52, 54, 56, the cables 70, 72 which cooperate with the pulleys 80, 82, 84, 86 cause the sliders which are connected to the cables 70, 72 to move relative to the load bearing beam 38. The sliders 60, 62, 64, 66 connected to the pulleys 80, 82. This allows the unloaded hoist mechanisms 50, 52, 54, 56 and sliders 60, 62, 64, 66 to be moved remotely to the proper position.

If no load is applied to the hoist mechanisms 50, 52, 54, 56, the shocks 116 and axle 112 will cooperate with the sliders 60, 62, 64, 66 to prevent the beam engagement plates 108 from engaging the flanges of the load bearing beam 38, allowing the wheels 114 to translate or move the sliders 60, 62, 64, 66 in a direction parallel to the longitudinal axis of the load bearing beam 38. In other words, when no load is applied, the spring loaded wheels 114 maintain the beam engagement plates 108 above the flange of the load bearing beam 38, allowing the sliders 60, 62, 64, 66 to easily move along the flange.

When a load is applied to the hoist mechanisms 50, 52, 54, 56, the load will cause the springs or shocks 116 to compress, causing the beam engagement plates 108 to engage or come into contact with the flange of the load bearing beam 38. As the beam engagement plates 108 contact with the flange, the friction between the beam engagement plates 108 and the flange act as a brake to maintain the sliders 60, 62, 64, 66 and the hoist mechanisms 50, 52, 54, 56 in position. This friction brake prevents the sliders 60, 62, 64, 66 movement or translation when the hoist mechanisms 50, 52, 54, 56 are lifting a payload.

Figure 7:
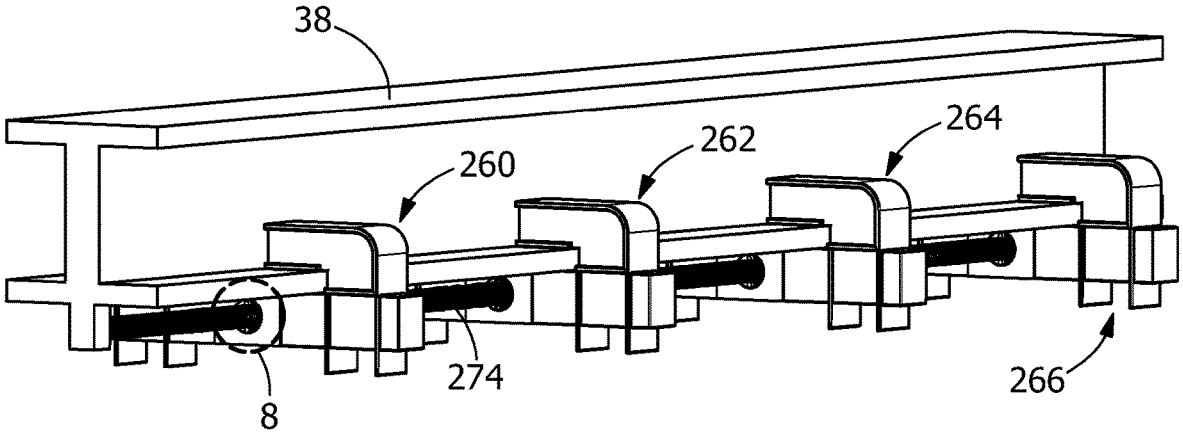
FIG. 7 is a perspective view of a first alternate slider.
Figure 8:
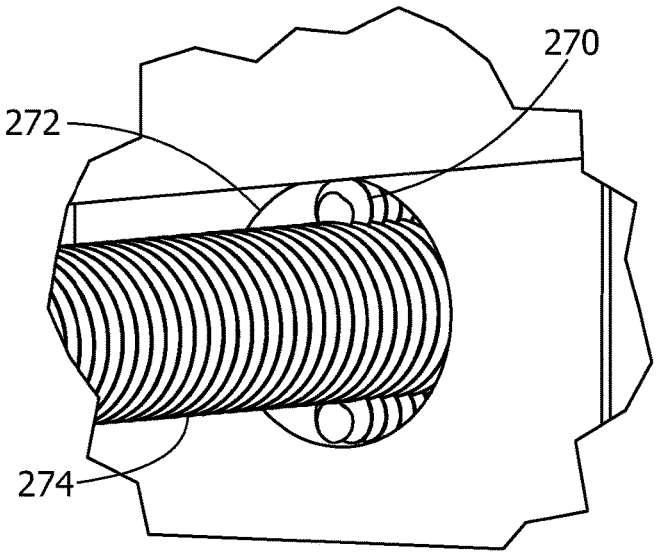
FIG. 8 is an enlarged perspective view of the worm gear and rod shown in FIG. 7.

A first alternate embodiment of the sliders 260, 262, 264, 266 is shown in FIGS. 7 and 8. In this illustrative embodiment, worm gears 270 are used to move and position the sliders 260, 262, 264, 266. Each worm gear 270 is positioned inside of a respective slider 260, 262, 264, 266 proximate an opening 272. A threaded rod 274 extends through the opening 272 and engages or meshes with the worm gear 270. Motors (not shown) are provided to drive the worm gears. The worm gear 270 will connect to the motor through meshing spur gears (not shown), one of which is an extension of the worm gear. The rotation of the worm gears 270 is transformed into linear motion by traveling along the treads of a fix rod 274 similar to a screw. The strength of this design falls with its simplicity. The only moving parts are the worm gears and the driving gears from the motor. In the event of a motor malfunction, a crank can be designed to turn the worm gear.

Figure 9:
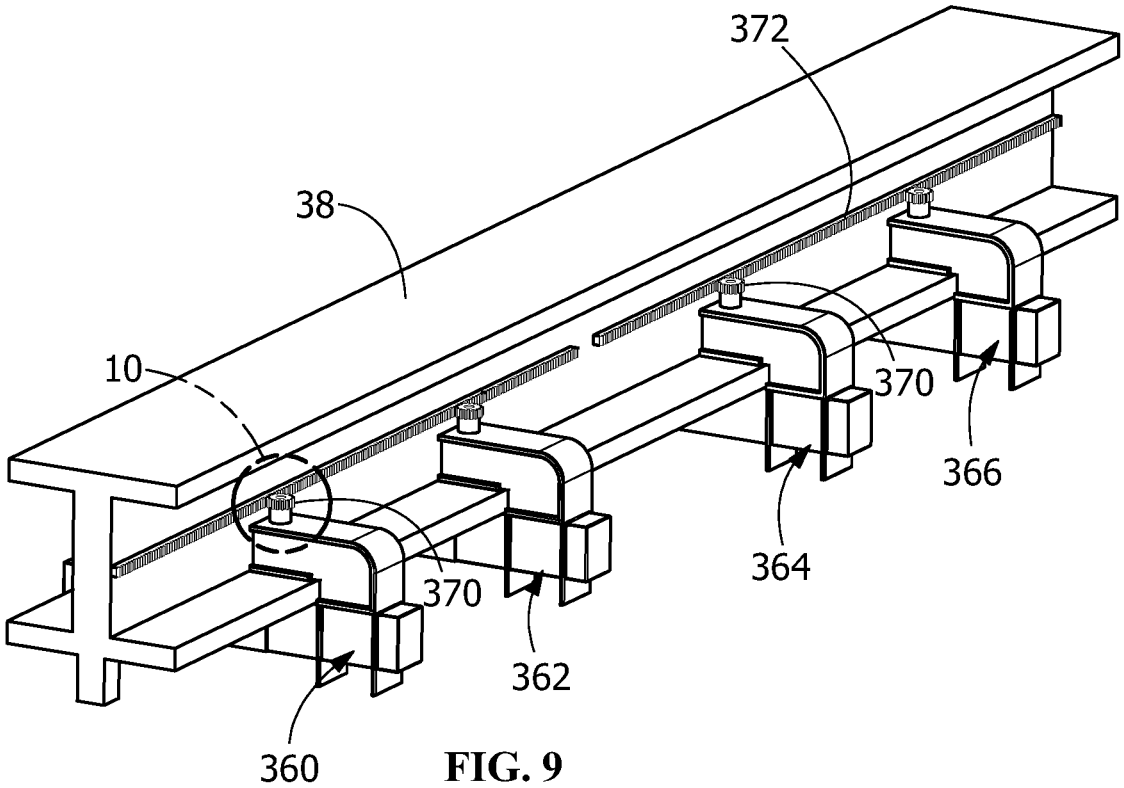
FIG. 9 is a perspective view of a second alternate slider.
Figure 10:
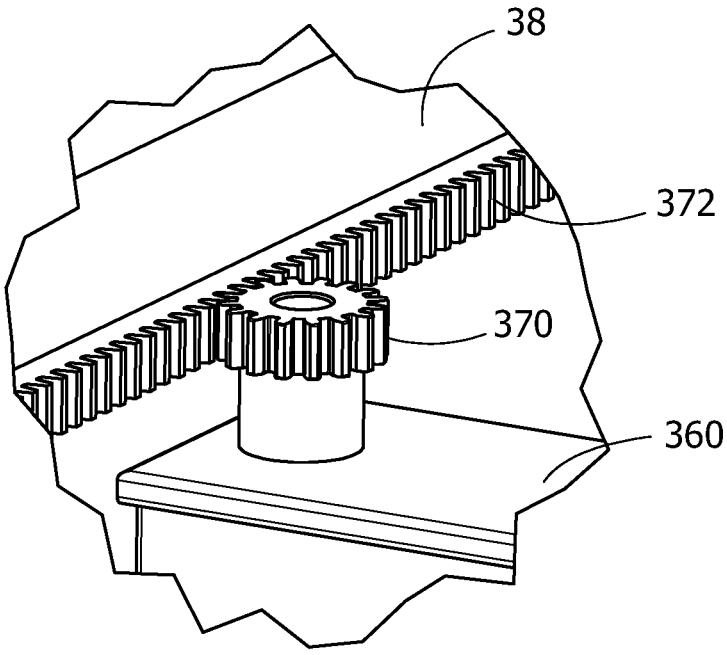
FIG. 10 is an enlarged perspective view of the pinion gear and rack shown in FIG. 9.

A second alternate embodiment of the sliders 360, 362, 364, 366 is shown in FIGS. 9 and 10. In this illustrative embodiment, a pinion gear 370 is attached to each side of each of the sliders 360, 362, 364, 366. The pinion gear 370 has the same pitch angle and pitch diameter as the rack 372 which is provided on the beam. A motor (not shown) provides torque to each of the gears 370. This torque will lead to a spinning motion by the gear 370, which will, in turn, lead to a translation motion of the sliders 360, 362, 364, 366.

While the sliders have been described for use with a gantry crane, the use of the sliders is not so limited. The sliders can be used with any type of crane or lifting mechanism which has beams on which the sliders can move. The number of load bearing beams or cross-beams may vary depending upon the application. In addition, the number of sliders used on each beam may vary according to the lifting needs.

Sliders having other types of drive mechanisms can be used with departing from the scope of the invention. In addition, while electrical motors have been described, the sliders may be driven other means, including, but not limited to, hydraulics or pneumatics.

In general terms, the method of moving the slider mechanism on the crane includes: providing a resilient member to resiliently maintaining the slider in a position in which the slider is movable relative to a beam of the crane when no load is applied to the slider; and compressing the resilient member when a load is applied to the slider to allow the slider to frictionally engage the beam to prevent the slider from continued movement relative to the beam.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A crane for lifting heavy loads, the crane comprising:
a beam having a flange;
a hoist for lifting the loads;
a slider for moving the hoist, the slider comprising;
a hoist support member;
mounting arms extending from either end of the support member, a portion of each mounting arm is spaced from the support member to form a flange receiving slot which is dimensioned to receive the flange of the beam;
a drive mechanism for moving the slider relative to the beam;
wheel mounting members attached to and extending from the mounting arms, each of the wheel mounting members extending from opposite sides of the mounting arms;
wheels extending from the wheel mounting members; and
springs are provided between the wheels and the wheel mounting members, the springs support the weight of the slider without creating contact on the flange of the beam when no load is applied to the slider.

2. A crane as recited in claim 1, wherein the drive mechanism includes pulleys, cables and motors.

3. A crane as recited in claim 1, wherein the drive mechanism includes worm gears in the slider and a threaded rod.

4. A crane as recited in claim 1, wherein the drive mechanism includes a pinion gear on the slider and a rack on the beam.

5. The crane as recited in claim 1, wherein beam engagement plates extend from the mounting arms into the flange receiving slots.

6. The crane as recited in claim 5, wherein when a load is applied to the slider, the load will cause the springs to compress, causing the beam engagement plates to engage the flange of the beam, preventing the continued movement of the slider on the beam.

7. The crane as recited in claim 6, wherein rods extend from the wheel mounting members and engage the wheels, the rods are movably attached to the wheel mounting members to allow the rods to move relative to the wheel mounting members, the springs are provided on each rod to control the movement of the rods and wheels.

8. The crane as recited in claim 1, wherein the wheels are rubber wheels which provide traction so that the sliders moves along the beam without slipping.

9. The crane as recited in claim 1, wherein cable attachment members extend from the wheel mounting members, the cable attachment members have openings which are dimensioned to receive and engage a cable to allow the cable attachment members and respective slider to move as the cable is moved.

10. A crane for lifting heavy loads, the crane comprising:
a beam having a flange;
a hoist for lifting the loads;
a slider for moving the hoist, the slider comprising;
a hoist support member;
mounting arms extending from either end of the support member, a portion of each mounting arm is spaced from the support member to form a flange receiving slot which is dimensioned to receive the flange of the beam;
a drive mechanism for moving the slider relative to the beam;
wheel mounting members attached to and extending from the mounting arms, each of the wheel mounting members extending from opposite sides of the mounting arms;
wheels extending from the wheel mounting members; and
cable attachment members extend from the wheel mounting members, the cable attachment members have openings which are dimensioned to receive and engage a cable to allow the cable attachment members and respective slider to move as the cable is moved.

11. A crane as recited in claim 10, wherein the drive mechanism includes pulleys, cables and motors.

12. A crane as recited in claim 10, wherein the drive mechanism includes worm gears in the slider and a threaded rod.

13. A crane as recited in claim 10, wherein the drive mechanism includes a pinion gear on the slider and a rack on the beam.

14. The crane as recited in claim 10, wherein springs are provided between the wheels and the wheel mounting members, the springs support the weight of the slider without creating contact on the flange of the beam when no load is applied to the slider.

15. The crane as recited in claim 14, wherein when a load is applied to the slider, the load will cause the springs to compress, causing beam engagement plates to engage the flange of the beam, preventing the continued movement of the slider on the beam.

16. The crane as recited in claim 10, wherein beam engagement plates extend from the mounting arms into the flange receiving slots.

17. The crane as recited in claim 10, wherein rods extend from the wheel mounting members and engage the wheels, the rods are movably attached to the wheel mounting members to allow the rods to move relative to the wheel mounting members.

* * * * *